US010892152B1

(12) United States Patent
Ugarov et al.

(10) Patent No.: US 10,892,152 B1
(45) Date of Patent: Jan. 12, 2021

(54) ADJUSTABLE DWELL TIME FOR SRM ACQUISITION

(71) Applicant: Thermo Finnigan LLC, San Jose, CA (US)

(72) Inventors: Mikhail V. Ugarov, San Jose, CA (US); Qingyu Song, Fremont, CA (US)

( * ) Notice: Subject to any disclaimer, the term of this patent is extended or adjusted under 35 U.S.C. 154(b) by 0 days.

(21) Appl. No.: 16/552,332

(22) Filed: Aug. 27, 2019

(51) Int. Cl.
*H01J 49/00* (2006.01)

(52) U.S. Cl.
CPC ..... *H01J 49/0031* (2013.01); *H01J 49/0036* (2013.01)

(58) Field of Classification Search
CPC .... H01J 49/0004; H01J 49/0072; H01J 49/02; H01J 49/025; H01J 49/0027; H01J 49/0031; H01J 49/0036
USPC ..... 250/281, 282, 288
See application file for complete search history.

(56) References Cited

U.S. PATENT DOCUMENTS

| | | | | |
|---|---|---|---|---|
| 7,482,580 | B2 | 1/2009 | Prest et al. | |
| 8,401,810 | B2 | 3/2013 | Sawada et al. | |
| 8,735,807 | B2 | 5/2014 | Mitchell et al. | |
| 9,429,549 | B2 | 8/2016 | Sumiyoshi | |
| 9,881,781 | B2 | 1/2018 | Green | |
| 10,564,135 | B2 | 2/2020 | Fujito | |
| 2014/0291504 | A1* | 10/2014 | Richardson | H01J 49/025 250/282 |
| 2016/0209378 | A1* | 7/2016 | Kobayashi | G01N 30/8644 |
| 2017/0047212 | A1 | 2/2017 | Kenny | |
| 2017/0162371 | A1* | 6/2017 | Schoen | H01J 49/421 |

FOREIGN PATENT DOCUMENTS

JP 2016053500 A 4/2016

OTHER PUBLICATIONS

Hancock, et al., "An Enhanced LC/MS/MS Method for the Determination of 81 Pesticide Residues in Fruit and Vegetables Using the Quattro Premier Mass Spectrometer", Waters Technical Note (2004), https://www.waters.com/webassets/cms/library/docs/720000840en.pdf.

Kiyonami et al., "Increased Selectivity, Analytical Precision, and Throughput in Targeted Proteomics", Molecular & Cellular Proteomics 2011, 10, Article 1074, pp. 1-11.

Lange et al., "Selected reaction monitoring for quantitative proteomics: a tutorial," Molecular Systems Biology 4:222 (2008), 14 pages.

* cited by examiner

*Primary Examiner* — Jason L McCormack
(74) *Attorney, Agent, or Firm* — David A. Schell

(57) ABSTRACT

A method of analyzing a sample includes setting initial dwells time for a plurality of transitions; monitoring the transitions during a mass spectrometry analysis; detecting a signal intensity above a first threshold for a first transition of the plurality of transitions; increasing a dwell time for the first transition in response to the signal intensity being above the first threshold; detecting the signal intensity for the first transition falling below a second threshold; and decreasing the dwell time for the first transition in response to the signal intensity falling below the second threshold.

16 Claims, 5 Drawing Sheets

ADJUSTABLE DWELL TIME FOR SRM ACQUISITION

FIELD

The present disclosure generally relates to the field of mass spectrometry including adjustable dwell times for single reaction monitoring (SRM) acquisition.

INTRODUCTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list.

Filter-type mass spectrometry systems can be used in a manner to monitor multiple precursor-product pairs or transitions simultaneously. Since only one ion can be isolated in such filters at any time, the available analysis time must be split between all the available transitions. Thus while instruments may approach 100% duty cycle of sampling some precursor, the overall efficiency of sampling is on the order of 0.1% (e.g. 1 Th isolation window for a 1000 Th mass range). From the foregoing it will be appreciated that a need exists for improved methods for scheduling the transitions to maximize the value of the data collected.

SUMMARY

In a first aspect, a method of analyzing a sample can include setting initial dwells time for a plurality of transitions; monitoring the transitions during a mass spectrometry analysis; detecting a signal intensity above a first threshold for a first transition of the plurality of transitions; increasing a dwell time for the first transition in response to the signal intensity being above the first threshold; detecting the signal intensity for the first transition falling below a second threshold; and decreasing the dwell time for the first transition in response to the signal intensity falling below the second threshold.

In various embodiments of the first aspect, increasing the first dwell time can result in a decrease to a second dwell time.

In various embodiments of the first aspect, decreasing the first dwell time can result in an increase to a second dwell time.

In various embodiments of the first aspect, the signal intensity can be recalibrated with respect to the dwell time and the response can be integrated over the peak duration to quantify a compound corresponding to the first transition.

In various embodiments of the first aspect, the initial dwell times can be equal for each of the plurality of transitions.

In various embodiments of the first aspect, the initial dwell times can be based on an expected intensity for the plurality of transitions.

In various embodiments of the first aspect, the initial dwell times can be based on a required detection level for compounds corresponding to the plurality of transitions.

In various embodiments of the first aspect, the method can further includes reducing the dwell time for the first transition when the signal intensity exceeds a third threshold.

In a second aspect, a mass spectrometer can include an ion source, a quadrupole mass filter, a detector, and controller. The ion source can be configured to produce an ion stream from a sample. The quadrupole mass filter can be configured to select ions within a mass-to-charge range and discard from the ion stream ions outside a mass-to-charge range; and cycle through a series of mass-to-charge ratios corresponding to a plurality of transitions, pausing on each mass-to-charge range for a dwell time corresponding to that transition. The detector can be configured to generate a signal proportional to the intensity of an incoming ion stream. The controller can be configured to set initial dwells time for the plurality of transitions; monitor the signal intensity of each of the plurality of transitions during a mass spectrometry analysis; detect a signal intensity crossing above a first threshold for a first transition of the plurality of transitions; increase a dwell time for the first transition in response to the signal intensity being above the first threshold; detect the signal intensity for the first transition falling below a second threshold; and decrease the dwell time for the first transition in response to the signal intensity falling below the second threshold.

In various embodiments of the second aspect, an increase in the first dwell time can result in a decrease to a second dwell time.

In various embodiments of the second aspect, a decrease in the first dwell time can result in an increase to a second dwell time.

In various embodiments of the second aspect, the controller can be further configured to recalibrate the signal intensity with respect to the dwell time and integrate the response over the peak duration to quantify a compound corresponding to the first transition.

In various embodiments of the second aspect, the initial dwell times can be equal for each of the plurality of transitions.

In various embodiments of the second aspect, the initial dwell times can be based on an expected intensity for the plurality of transitions.

In various embodiments of the second aspect, the initial dwell times can be based on a required detection level for compounds corresponding to the plurality of transitions.

In various embodiments of the second aspect, the controller can be further configured to reduce the dwell time for the first transition when the signal intensity exceeds a third threshold.

In a third aspect, a method of analyzing a sample can include performing an initial mass spectrometry analysis of a sample to obtain signal intensities for a plurality of transitions; setting dwells time for the plurality of transitions based on the signal intensities determined initial mass spectrometry analysis of a sample; performing a second mass spectrometry analysis of the sample using the dwell times; measuring ion intensities for the plurality of transitions as a function of time during the second mass spectrometry analysis; and quantifying compounds corresponding to the plurality of transitions based on integration of the ion intensity over at least one peak.

In various embodiments of the third aspect, the dwell times during the initial mass spectrometry analysis can be equal for each of the plurality of transitions.

In various embodiments of the third aspect, the dwell times during the initial mass spectrometry analysis can be based on an expected intensity for the plurality of transitions.

In various embodiments of the third aspect, the dwell times during the initial mass spectrometry analysis can be based on a required detection level for compounds corresponding to the plurality of transitions.

DRAWINGS

For a more complete understanding of the principles disclosed herein, and the advantages thereof, reference is now made to the following descriptions taken in conjunction with the accompanying drawings, in which.

Figure 1:
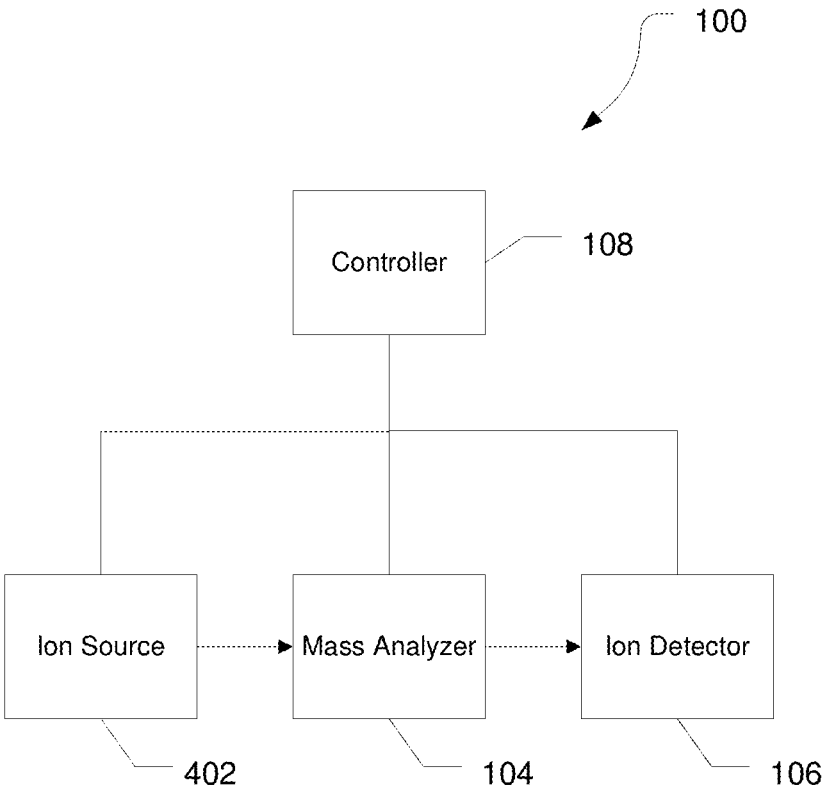
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass-to-charge ratio of the ions. For example, the mass analyzer 104 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Dwell Times

Filter-type mass spectrometry systems are used in a manner to monitor multiple precursor-product pairs simultaneously. Since only one ion can be isolated in such filters at any time, the available analysis time must be split between all the available transitions.

Unfortunately, different compounds often display different signal levels. In addition, the target quantitation levels may vary in the wide range. As a result, application of similar dwell time to all compounds does not allow for optimal distribution of the available acquisition time and puts "difficult" target at a disadvantage.

Alternative approaches are known in the art to address uneven distribution of LC elution peaks along the length of a chromatogram. For example, analysis of specific sub-sets of transitions can be scheduled to happen only during pre-determined windows in time, thus reducing the number of transitions running in parallel and increasing the corresponding dwell time. Still, this approach does not differentiate between these transitions and the same dwell is applied to all of them.

In another approach, different dwell times can be specified manually for all compounds. While this may accomplish the goal, the task could be daunting and in case of hundreds of compounds rather un-practical. In addition, as the level of analyte is often unknown prior to the LC/MS run, such fixed-value approach may not work in most cases.

Previously, several approaches have been proposed to improve time utilization by dynamically altering the acquisition timing based on acquired data. For example, Prest et. al. (U.S. Pat. No. 7,482,580 B2) suggested that the time period for the ion detection can be terminated based on the results of detector output monitoring in real time in order to reduce the overall cycle time. This method may work for very strong and very weak transitions where the outcome of the quantitation is statistically satisfactory during the acquisition. However, this method would not work well for a typical LCMS experiment where the peak shape and duration vary, and reliable quantitation requires full sampling on the ion elution profile.

In another prior art example by Green (U.S. Pat. No. 9,881,781 B2) it is taught to discontinue monitoring or reduce monitoring dwell time upon the emergence of an ion. This has a potential to improve the analysis duty cycle. However, the success of this approach depends on whether the observed ion signal is reliably identified as a chromatographic peak which may not always be easy for weaker signals and less than perfect peak shapes. This limits the usability of this method and can even lead to missing real peaks if monitoring of the ion signal is terminated prematurely.

In addition, critically, none of the above patents teach real-time adjustment of dwell time based on the start of the chromatographic elution of an ion by detecting the rising edge of the chromatographic peak.

Figure 2:
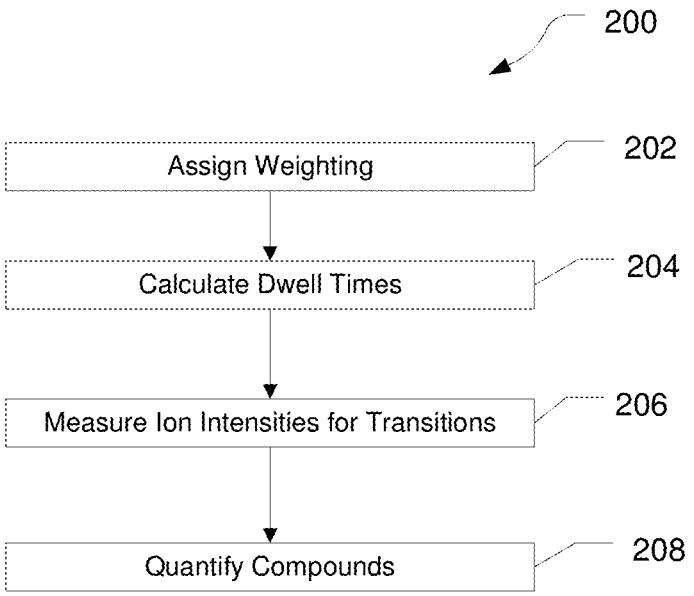
FIGS. 2, 3 and 4 are flow diagrams illustrating exemplary method of determining dwell times, in accordance with various embodiments.

FIG. 2 illustrates an exemplary method 200 for determining dwell times. At 202, transitions can be assigned a weighting. A transition represents a particular fragment ion of a parent ion. The signal intensity for a given transition can be a function of the abundance of the parent ion and the rate at which the particular fragment ion is produced. The abundance of the parent ion can be a function of the concentration of a compound that gives rise to the parent ion as well as the ion ionization efficiency of the compound to produce the parent ion. Low intensity transitions can be given a greater weight than high abundance compounds which can result in a longer dwell times for low abundance compounds.

In exemplary embodiments, the weightings can be assigned based on an expected intensity, such as based on the known relative response of the analytes and "brightness" of specific transitions. Transitions with higher expected intensity can be given a lower weight than transitions with lower intensity. In other embodiments, the weightings can be assigned based on the regulatory limits being targeted. Compounds with lower regulatory limits can be given a greater weight to ensure accurate detection of the compound at or close to the regulatory limits.

At 204, dwell times can be calculated using the weightings to build an analysis method. In an exemplary embodiment, the dwell time can be calculated according to Equation 1. If there are N simultaneous transitions, then $DT_i$ is the dwell time for transition i, $T_s$ is cycle time (analysis time available for all transitions), and $W_i$ is the weight for transition i.

$$DT_i = \frac{T_S W_i}{N \sum_{j=0}^{N} W_j}. \qquad \text{Equation 1}$$

A method can be built where individual dwell times are determined to maximize the acquisition time for transitions with anticipated lower signal levels. Additionally, scheduling of acquisition "windows" or "segments" can also be performed to further optimize time use. Also, the sequence of transitions can be optimized to reduce interscan (settling) time. Factors such as difference in m/z of parent and product ions can be considered in the process.

At 206, method can be performed and the intensities for the transitions can be monitored according to the scheduled determined in 204, and at 208, the compounds can be quantified according to the measured intensities.

Figure 3:
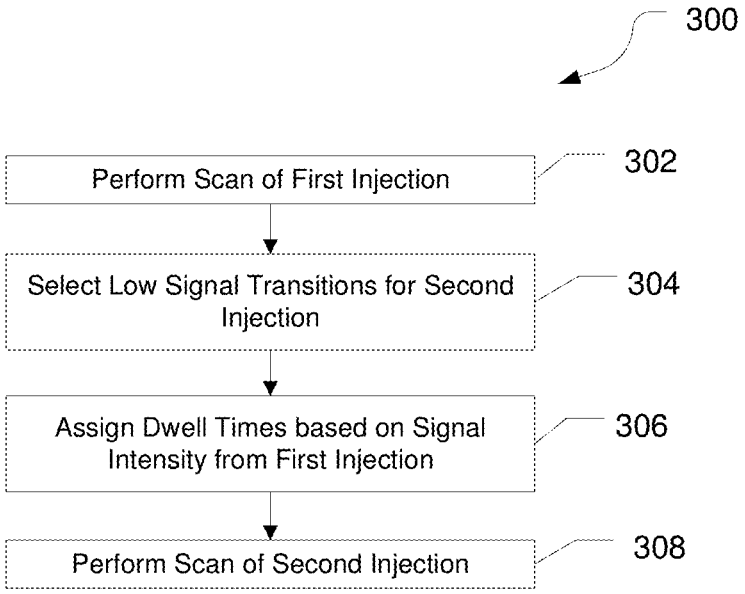

FIG. 3 illustrates another exemplary method 300 for determining dwell times. At 302, an analysis can be performed on a first injection of the sample. In various embodiments, all targeted transitions can be monitored during the initial analysis. The dwell times can be equal or assigned weights, such as according to method 200. Additionally, the transitions can be scheduled during acquisition windows and sequenced to reduce interscan delays.

At 304, transitions with a low signal can be identified from the initial analysis. Transitions with sufficient data collected to sufficiently quantify compounds can be excluded from a subsequent analysis of the same sample. By excluding transitions with sufficient data from the initial analysis, more time can be devoted to the analysis of low signal transitions.

At 306, the dwell times can be determined empirically based on the quantitation results from the first run. The optimum dwell times can be calculated so that weaker transitions are assigned longer dwell times. In addition, retention time windows for transitions can be reassigned if necessary.

At 308, the second injection is performed and the new quantitative analysis is performed.

This approach can require splitting the available sample, or have a double amount ready. Also, this approach requires doubling the analysis time which can be seen as a disadvantage. However, the sensitivity and limit of quantitation gains from the optimization should in many cases compensate for this potential disadvantage and enable an experiment that would otherwise be impossible due to low sensitivity for some compounds.

The sensitivity gains can be further boosted if the first injection run is used not just to estimate intensities for the second run optimization, but as a quantitative run as well, at least for the stronger ion signals. Then the second run can be limited to those "weaker transitions" with even more potential increase in signal quality.

Figure 4:
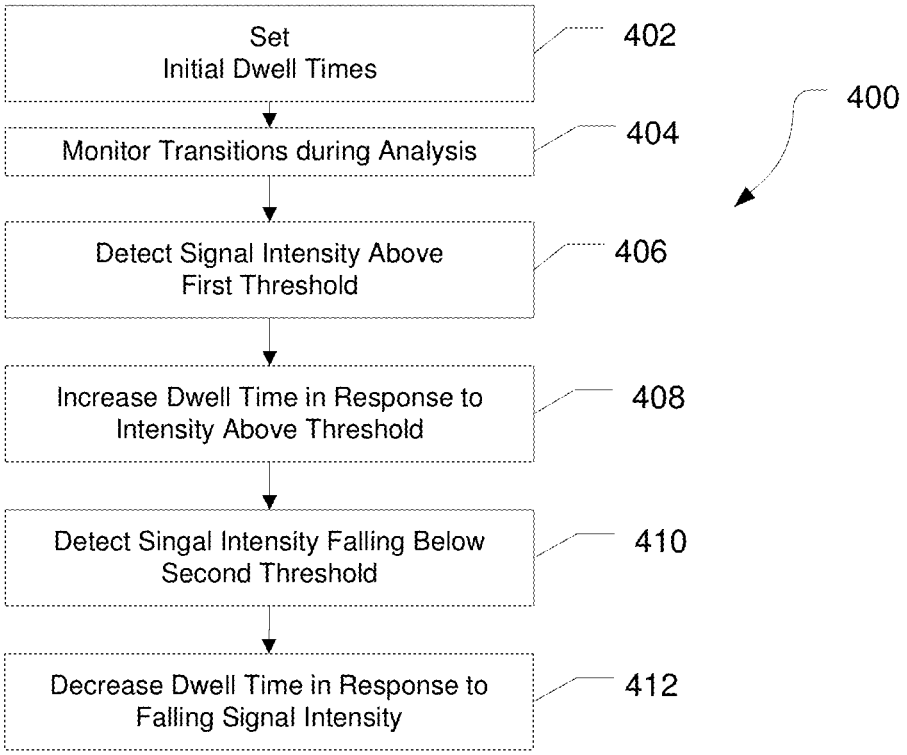

FIG. 4 illustrates another exemplary method 400 for dynamically determining dwell times. At 402, a set of initial dwell times can be determined. In various embodiments, transitions assigned to a time window (segment) can be given equal dwell times. In various embodiments, the dwell times can be specified or determined in accordance with method 200. In still further embodiments, an initial scan can be used to determine initial dwell times as in method 300.

At 404, the transitions can be monitored during the analysis. At 406, the signal intensity for a transition increases above a first threshold can be detected, signaling the start of the relevant chromatographic peak At 408, in response to detecting the increasing signal intensity, a change can be triggered to increase the dwell time for this particular compound at the expense of other transitions that are not currently active. Subsequently, if peaks corresponding to the elution of additional compounds appear in spectra, their respective dwell times are increased to give more acquisition time.

At 410, when the falling edge of the peak is detected by the data acquisition module, and the intensity falls below a pre-defined level, the transition is removed from the list of "active" ones, and is therefore give the minimum (or zero) dwell time for the duration of the chromatographic run, as indicated at 412.

Thus, at any time during the run the "active" transitions can gain a boost in acquisition time compared to a regular run with uniform dwell.

Even though the dwell time is set dynamically and may be adjusted during the actual peak elution, reproducible quantitation can be achieved as the data processor can constantly recalibrate the signal with respect to the current dwell. The overall response is then calculated as an integral over the entire peak duration, as indicated at 414.

In various embodiments, the dwell time can be reduced after step 408 and before step 410 is the signal intensity exceeds a second threshold indicative an intense transition.

Figure 5:
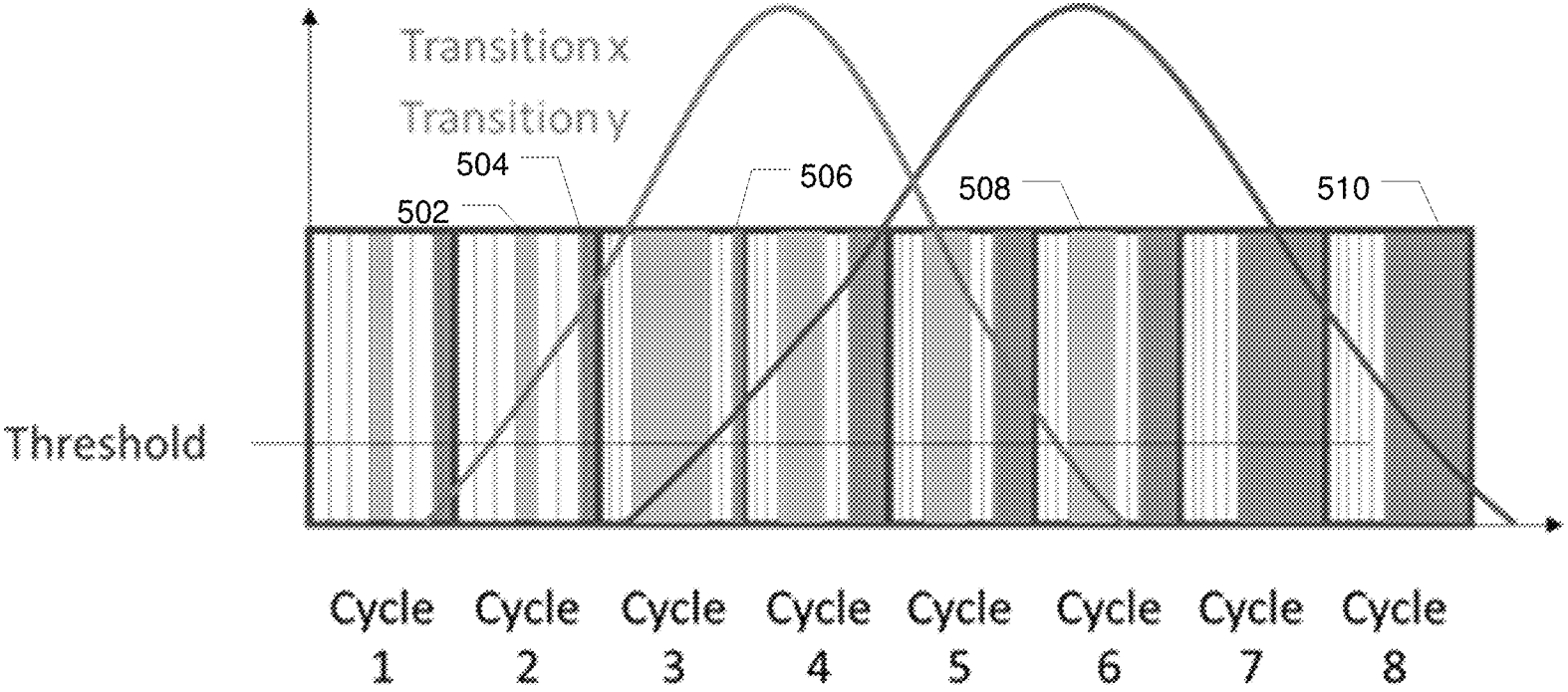
FIG. 5 is a timing diagram illustrating dwell times during an analysis, in accordance with various embodiments.

FIG. 5 provides an illustration of an exemplary analysis. During cycle 1, transition x and transition y are both below the threshold.

During cycle 2, transition x is detected above the threshold at 502 while transition y is still below the threshold at 504.

For cycle 3, the dwell time for transition x is significantly increased with decreases in the other dwell times, including the dwell time for transition y. However, at 506, the intensity for transition y is measured above the threshold.

For cycles 4 and 5, both transition x and transition y are active and the dwell time for transition y is increased. While the dwell time for transition x is decreased relative to cycle 3 when transition x was the only active transition, transition x is not decreased to the extent of other inactive transitions.

During cycle 6, the intensity of transition x falls below the threshold at, removing transition x from the active list. Thus in cycle 7, the dwell time for transition x is reduced to 0, providing a further increase in the dwell time for transition y as it is the only active transition during cycles 7 and 8. During cycle 8 at 510, transition y falls below the threshold and can be removed from the active transition list.

Computer-Implemented System

Figure 6:
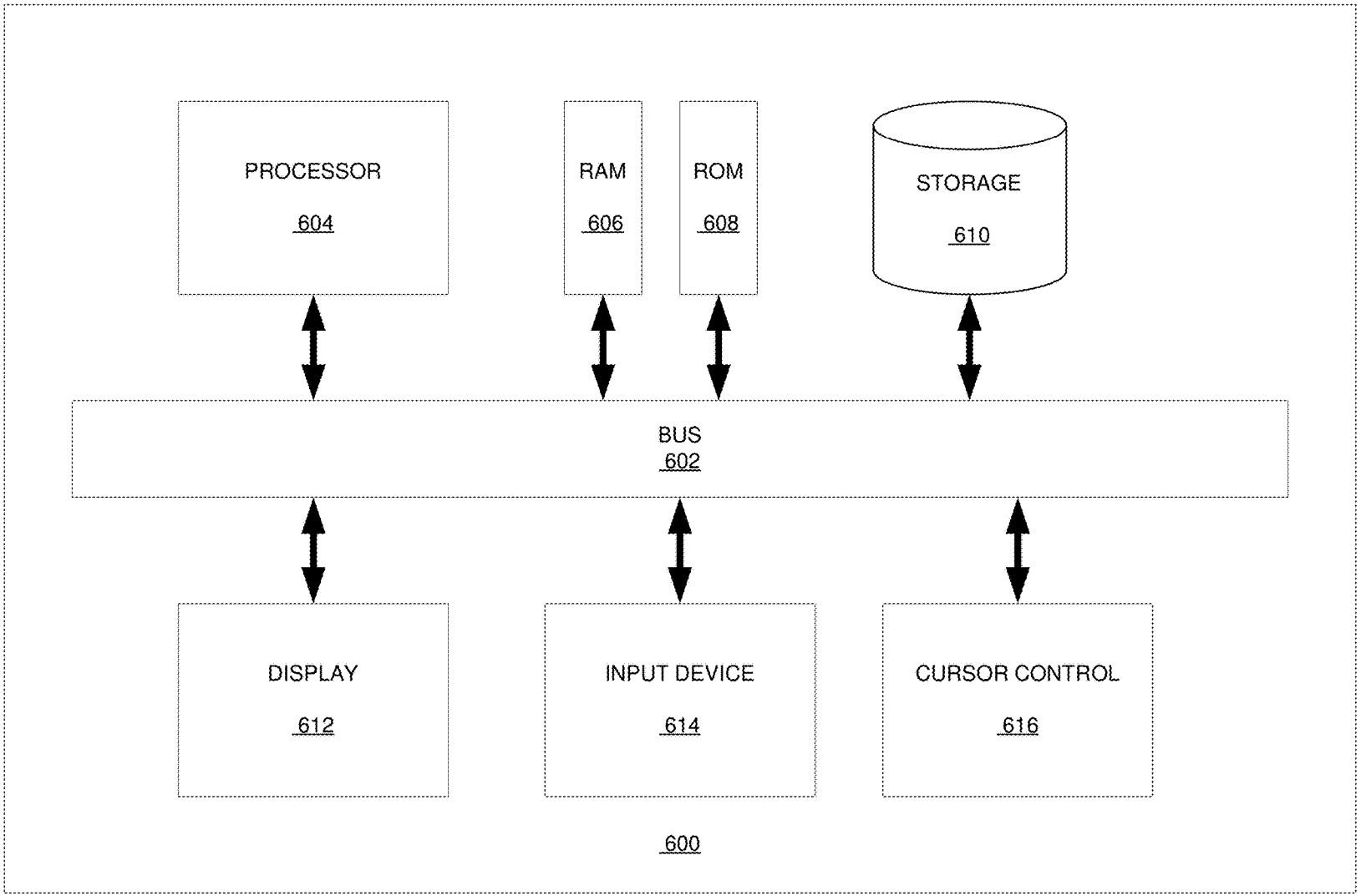
FIG. 6 is a block diagram illustrating an exemplary data analysis system, in accordance with various embodiments.

FIG. 6 is a block diagram that illustrates a computer system 600, upon which embodiments of the present teachings may be implemented as which may incorporate or communicate with a system controller, for example controller 110 shown in FIG. 1, such that the operation of components of the associated mass spectrometer may be adjusted in accordance with calculations or determinations made by computer system 600. In various embodiments, computer system 600 can include a bus 602 or other communication mechanism for communicating information, and a processor 604 coupled with bus 602 for processing information. In various embodiments, computer system 600 can also include a memory 606, which can be a random access memory (RAM) or other dynamic storage device, coupled to bus 602, and instructions to be executed by processor 604. Memory 606 also can be used for storing temporary variables or other intermediate information during execution of instructions to be executed by processor 604. In various embodiments, computer system 600 can further include a read only memory (ROM) 608 or other static storage device coupled to bus 602 for storing static information and instructions for processor 604. A storage device 610, such as a magnetic disk or optical disk, can be provided and coupled to bus 602 for storing information and instructions.

In various embodiments, computer system 600 can be coupled via bus 602 to a display 612, such as a cathode ray tube (CRT) or liquid crystal display (LCD), for displaying information to a computer user. An input device 614, including alphanumeric and other keys, can be coupled to bus 602 for communicating information and command selections to processor 604. Another type of user input device is a cursor control 616, such as a mouse, a trackball or cursor direction keys for communicating direction information and command selections to processor 604 and for controlling cursor movement on display 612. This input device typically has two degrees of freedom in two axes, a first axis (i.e., x) and a second axis (i.e., y), that allows the device to specify positions in a plane.

A computer system 600 can perform the present teachings. Consistent with certain implementations of the present teachings, results can be provided by computer system 600 in response to processor 604 executing one or more sequences of one or more instructions contained in memory 606. Such instructions can be read into memory 606 from another computer-readable medium, such as storage device 610. Execution of the sequences of instructions contained in memory 606 can cause processor 604 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A method of analyzing a sample, comprising:

setting initial dwell times for a plurality of transitions, the initial dwell times are equal for each of the plurality of transitions, the initial dwell times are based on an expected intensity for the plurality of transitions, or the initial dwell times are based on a required detection level for compounds corresponding to the plurality of transitions;

monitoring the transitions during a mass spectrometry analysis;

detecting a signal intensity above a first threshold for a first transition of the plurality of transitions;

increasing a dwell time for the first transition in response to the signal intensity being above the first threshold;

detecting the signal intensity for the first transition falling below a second threshold;

decreasing the dwell time for the first transition in response to the signal intensity falling below the second threshold.

2. The method of claim 1, wherein increasing the first dwell time results in a decrease to a second dwell time.

3. The method of claim 1, wherein decreasing the first dwell time results in an increase to a second dwell time.

4. The method of claim 1, wherein the signal intensity is recalibrated with respect to the dwell time and the response is integrated over the peak duration to quantify a compound corresponding to the first transition.

5. The method of claim 1, wherein the initial dwell times are equal for each of the plurality of transitions.

6. The method of claim 1, wherein the initial dwell times are based on an expected intensity for the plurality of transitions.

7. The method of claim 1, wherein the initial dwell times are based on a required detection level for compounds corresponding to the plurality of transitions.

8. The method of claim 1, further comprising reducing the dwell time for the first transition when the signal intensity exceeds a third threshold.

9. A mass spectrometer comprising:

an ion source configured to produce an ion stream from a sample;

a quadrupole mass filter configured to:

select ions within a mass-to-charge range and discard from the ion stream ions outside a mass-to-charge range; and cycle through a series of mass-to-charge ratios corresponding to a plurality of transitions, pausing on each mass-to-charge range for a dwell time corresponding to that transition;

a detector configured to generate a signal proportional to the intensity of an incoming ion stream;

controller configured to:

set initial dwell times for the plurality of transitions, the initial dwell times are based on an expected intensity for the plurality of transitions, the initial dwell times are based on an expected intensity for the plurality of transitions, or the initial dwell times are based on a required detection level for compounds corresponding to the plurality of transitions;

monitor the signal intensity of each of the plurality of transitions during a mass spectrometry analysis;

detect a signal intensity crossing above a first threshold for a first transition of the plurality of transitions;

increase a dwell time for the first transition in response to the signal intensity being above the first threshold;

detect the signal intensity for the first transition falling below a second threshold;

decrease the dwell time for the first transition in response to the signal intensity falling below the second threshold.

10. The mass spectrometer of claim 9, wherein an increase in the first dwell time results in a decrease to a second dwell time.

11. The mass spectrometer of claim 9, wherein a decrease in the first dwell time results in an increase to a second dwell time.

12. The mass spectrometer of claim 9, wherein the controller is further configured to recalibrate the signal intensity with respect to the dwell time and integrate the response over the peak duration to quantify a compound corresponding to the first transition.

13. The mass spectrometer of claim 9, wherein the initial dwell times are equal for each of the plurality of transitions.

14. The mass spectrometer of claim 9, wherein the initial dwell times are based on an expected intensity for the plurality of transitions.

15. The mass spectrometer of claim 9, wherein the initial dwell times are based on a required detection level for compounds corresponding to the plurality of transitions.

16. The mass spectrometer of claim 9, wherein the controller is further configured to reduce the dwell time for the first transition when the signal intensity exceeds a third threshold.

* * * * *